US005557369A

United States Patent [19]

Shiga et al.

[11] Patent Number: 5,557,369

[45] Date of Patent: Sep. 17, 1996

[54] RECORDING APPARATUS WITH DETECTION OF MANUALLY INSERTED RECORDING SHEET

[75] Inventors: Mikio Shiga; Tamaki Hashimoto, both of Yokohama, Japan

[73] Assignee: Canon Kabushiki Kaisha, Tokyo, Japan

[21] Appl. No.: 195,191

[22] Filed: Feb. 14, 1994

[30] Foreign Application Priority Data

Mar. 2, 1993 [JP] Japan ..... 5-066140

[51] Int. Cl.[6] ..... G03G 21/00

[52] U.S. Cl. ..... 355/204; 400/582

[58] Field of Search ..... 355/308, 309, 355/204, 208; 400/76, 596, 582, 583, 605; 364/930, 939, 948.1; 347/104, 154, 153; 346/134, 104, 136; 271/9.09

[56] References Cited

U.S. PATENT DOCUMENTS

| | | | |
|---|---|---|---|
| 4,589,785 | 5/1986 | Sato | 364/930 X |
| 4,925,325 | 5/1990 | Niikawa | 400/582 |
| 4,998,216 | 3/1991 | Hino et al. | 271/9.09 |
| 5,223,858 | 6/1993 | Yokoi et al. | 355/308 X |

FOREIGN PATENT DOCUMENTS

| | | |
|---|---|---|
| 60-72763 | 4/1985 | Japan . |
| 1-087258 | 3/1989 | Japan . |
| 1-150638 | 6/1989 | Japan . |
| 4-041282 | 2/1992 | Japan . |
| 5-088489 | 4/1993 | Japan . |

*Primary Examiner*—Arthur T. Grimley
*Assistant Examiner*—Shuk Y. Lee
*Attorney, Agent, or Firm*—Fitzpatrick, Cella, Harper & Scinto

[57] ABSTRACT

In a recording apparatus, a recording operation is controlled by being connected to a host computer. The apparatus includes a sheet supporting unit for supporting a plurality of sheets, a feeding unit for feeding a sheet supported by the sheet supporting unit, a manual insertion port for manually inserting a sheet into the main body of the apparatus, a conveying unit for conveying the sheet fed from the sheet supporting unit or the sheet inserted from the manual insertion port, a recording unit for performing a recording operation on the sheet fed by the conveying unit, a sheet detection unit for detecting the sheet inserted from the manual insertion port, and a control unit for causing the apparatus to execute a recording operation in a manual insertion mode based on the detection of the manually inserted sheet by the sheet detection unit, and for temporarily providing an off-line state with respect to the host computer after the recording operation has been completed.

12 Claims, 6 Drawing Sheets

RECORDING APPARATUS WITH DETECTION OF MANUALLY INSERTED RECORDING SHEET

BACKGROUND OF THE INVENTION

1. Field of the Invention

This invention relates to a recording apparatus, such as a printer, a copier, a facsimile or the like, which determines whether the current sheet-feeding operation is a manual sheet-feeding operation or an automatic sheet-feeding operation using detection means for detecting the presence of a sheet and sheet feeding means.

2. Description of the Related Art

In some of conventional recording apparatuses, such as printers, copiers, facsimiles or the like, an automatic sheet-feeding device for automatically feeding a sheet is mounted. Such devices are classified into two types; i.e., a type which can be separated from the recording apparatus, and a type which is incorporated and fixed in the recording apparatus.

FIG. 6 illustrates an example of the above-described recording apparatus. In general, an automatic sheet-feeding device 107 provided in this recording apparatus 101 executes a sheet-feeding operation before performing a recording operation when information indicating that certain information is to be recorded has been input.

In general, a sheet sensor for detecting if a sheet of recording paper has been inserted is provided in recording apparatus 101, and operations of setting the position of the leading end of the sheet, ending the sheet, and the like are controlled based on signals from the sheet sensor.

The operator performs a manual sheet-feeding operation by inserting a sheet of recording paper from manual sheet-feeding port 117. In general, the manual sheet-feeding operation is not consecutively performed. However, when using particular recording paper, such as envelopes, post cards or the like, the manual sheet-feeding operation is, in some cases, consecutively performed. The conventional recording apparatus 101 includes a switch for switching between an automatic sheet-feeding mode and a manual sheet-feeding mode in order to consecutively execute the manual sheet-feeding operation.

Even in the conventional recording apparatus 101 in which the automatic sheet-feeding device 107 is mounted, when performing recording on different recording paper during a recording operation, a sheet of the recording paper is manually inserted whenever necessary. In the conventional recording apparatus 101, an automatic sheet-feeding operation and a manual sheet-feeding operation are operated by switching between the two kinds of operations using the switch.

Such switching between the two kinds of operations using the switch in the conventional recording apparatus 101 causes a complicated configuration of the apparatus, complication in the operations, and an increase in the production cost of the apparatus.

SUMMARY OF THE INVENTION

The present invention has been made in consideration of the above-described problems.

It is an object of the present invention to provide a recording apparatus, in which a switch is unnecessary, and it is possible to automatically move from an automatic sheet-feeding mode to a manual sheet-feeding mode.

According to one aspect, the present invention which achieves the above-described object relates to a recording apparatus comprising sheet supporting means for accommodating sheets, sheet feeding means for feeding a sheet supported by the sheet supporting means, detection means for detecting the sheet fed by the sheet feeding means, and control means for causing the apparatus to execute an automatic sheet-feeding operation when the detection means has detected the sheet fed by the sheet feeding means, and for causing the apparatus to execute a manual sheet-feeding operation when the detection means has detected a sheet not fed by the sheet feeding means and fop automatically providing an off-line state when the sheet is discharged.

When the detection means has detected a sheet when a sheet-feeding signal for operating the sheet feeding means is not output, the control means may determine that a manual sheet-feeding operation has been started, and cause the apparatus to execute the manual sheet-feeding operation.

When the detection means has detected a sheet for at least a predetermined time period, the control means may determine that a manual sheet-feeding operation has been started, and cause the apparatus to execute the manual sheet-feeding operation.

A time period of about 1 second–3 seconds is suitable for the predetermined time period.

After the recording operation of the manually fed sheet has been completed, the control means may provide an off-line state.

The off-line state may be released by input means outside the apparatus.

According to another aspect, the present invention relates to a recording apparatus comprising sheet supporting means for accommodating sheets, sheet feeding means for feeding a sheet supported by the sheet supporting means, detection means for detecting the sheet fed by the sheet feeding means, and control means for causing the apparatus to execute an automatic sheet-feeding operation when the detection means has detected the sheet fed by the sheet feeding means, and for causing the apparatus to execute a manual sheet-feeding operation irrespective of an on-line state or an off-line state when the detection means has detected a sheet not fed by the sheet feeding means.

When the detection means has detected a sheet when a sheet-feeding signal for operating the sheet feeding means is not output, the control means may determine that a manual sheet-feeding operation has been started, and cause the apparatus to execute the manual sheet-feeding operation.

When the detection means has detected a sheet for at least a predetermined time period, the control means may determine that a manual sheet-feeding operation has been started, and cause the apparatus to execute the manual sheet-feeding operation.

A time period of about 1 second–3 seconds is suitable for the predetermined time period.

The control means operates also in an error state other than a jam.

According to the recording apparatus of the present invention, the apparatus can automatically move from an automatic sheet-feeding operation to a manual sheet-feeding operation, and a manual sheet-feeding operation is automatically executed when the operator has manually inserted a sheet.

DETAILED DESCRIPTION OF THE PREFERRED EMBODIMENTS

Preferred embodiments of the present invention will now be described with reference to the drawings.

Figure 1:
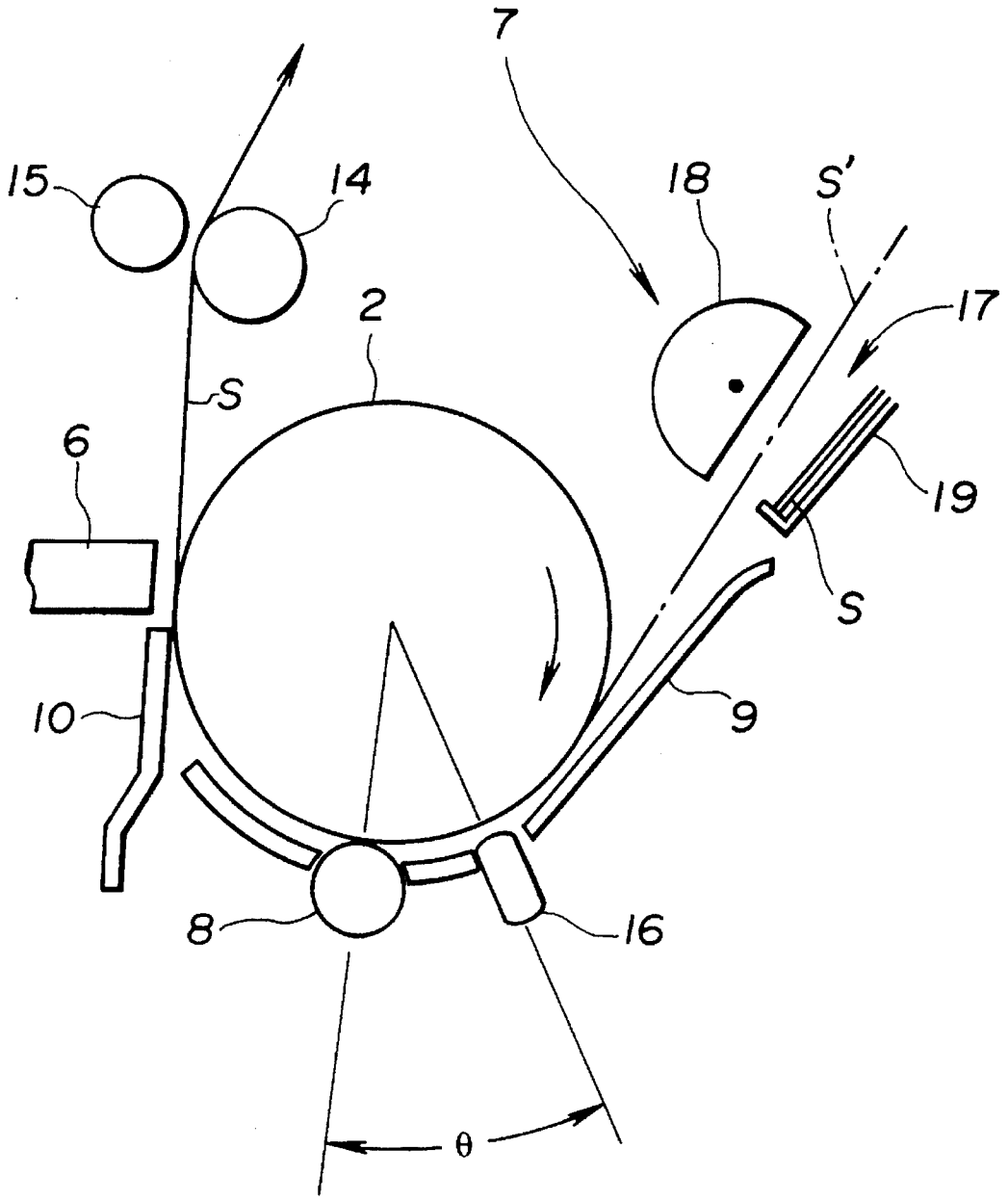
FIG. 1 s a cross-sectional view of a recording apparatus of the present invention.
Figure 2:
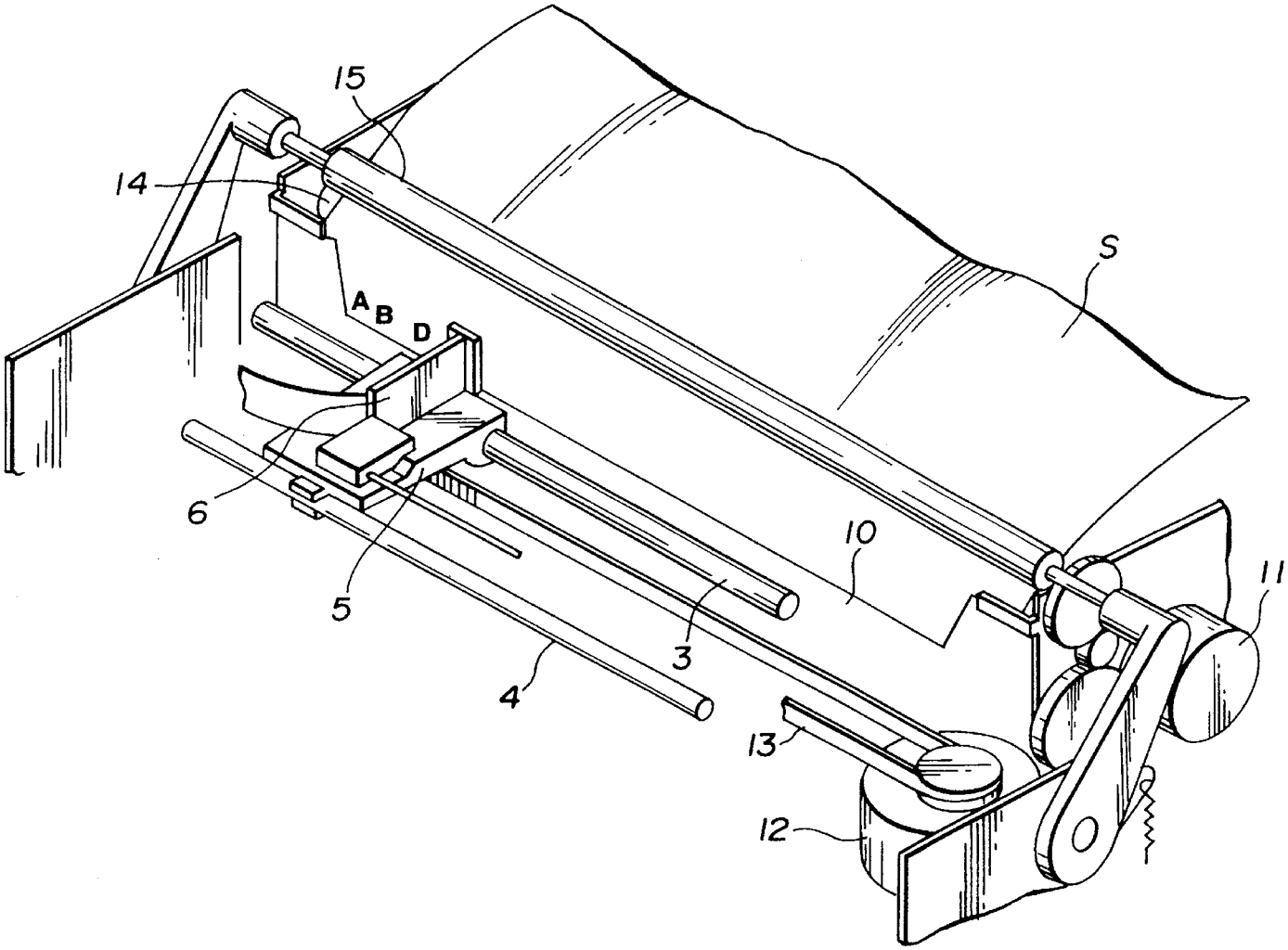
FIG. 2 is a perspective view of the recording apparatus shown in FIG. 1.

FIG. 2 is a perspective view of recording apparatus 1 to which the present invention is suitably applied. FIG. 1 is a cross-sectional view of the apparatus shown in FIG. 2.

In FIGS. 1 and 2, a supplied sheet of recording paper S is conveyed in close contact with the circumferential surface of sheet-feeding roller 2, serving as sheet-feeding means also functioning as a platen. Recording head (recording unit) 6 is mounted on carriage 5 reciprocating along guide shafts 3 and 4 provided in parallel to and in front of sheet-feeding roller 2.

Pinch roller 8 for providing the sheet with a frictional conveying force is in pressure contact with sheet-feeding roller 2 at a lower circumferential portion thereof. Paper pan 9 for forming a sheet-conveying path is provided from a portion where the sheet is fed to a downstream region of sheet-feeding roller 2 in the sheet-feeding direction.

Pressing plate 10 for preventing the sheet from deviating from recording head 6 is provided at a position immediately before recording head 6 in the vicinity of the circumference of sheet-feeding roller 2.

The sheet-feeding roller 2 is driven by sheet-feeding motor 11, and the carriage 5 is driven by carriage motor 12 via timing belt 13.

In the recording method of the present embodiment, an ink image is recorded on a sheet of recording paper. An ink-jet recording method is preferably used.

An apparatus of the ink-jet recording method includes a liquid-discharging port for discharging a recording ink liquid in the form of flying droplets, a liquid channel communicating with the liquid-discharging port, and discharging-energy generation means, provided at a part of the liquid channel, for providing a discharging energy for discharging the ink liquid within the liquid channel. The dicharging-energy generation means is driven in accordance with an image signal to discharge ink droplets, whereby an image is recorded.

The discharging-energy generation means comprises, for example, pressure-energy generation means, such as an electromechanical transducer (for example, a piezoelectric element) or the like, electromagnetic-energy generation means for heating an ink liquid by irradiating it with an electromagnetic wave from a laser or the like and for discharging ink droplets as a result of the heating, or thermal-energy generation means for discharging ink droplets by heating an ink liquid by an electrothermal transducer. The thermal-energy generation means using an electrothermal transducer or the like is preferable among the above-described means, because a liquid-discharging port can be arranged with a high density, and it is thereby possible to perform recording with a high resolution and to reduce the size of recording head 6.

Sheet discharging means, comprising discharging roller 14 and discharging pinch roller 15, is provided at a side downstream from recording head 6 (sheet-discharging side).

Sheet sensor 16 for detecting the presence of a sheet of recording paper S (the passage of the leading end and the trailing end of the sheet) is disposed at a position facing the circumferential surface of sheet-feeding roller 2, and at a predetermined position at a side upstream from pinch roller 8 as viewed in FIG. 1.

An automatic sheet feeder (cut-sheet feeder) 7 is mounted in the recording apparatus 1 shown in FIGS. 1 and 2. The uppermost sheet of recording paper S mounted on sheet tray (sheet supporting means) 19 of automatic sheet feeder 7 is fed by sheet-feeding roller 18, serving as sheet feeding means. The fed sheet of recording paper S is conveyed to a pressing portion of pinch roller 8 after passing through sheet sensor 16 along paper pan 9.

A manual sheet-feeding port 17 is provided between sheet feeding roller 18 and sheets of recording paper S mounted on sheet tray 19 of automatic sheet feeder 7. The operator inserts each sheet from manual sheet-feeding port 17. The sheet of recording paper S' inserted by the operator is detected by sheet sensor 16.

The manually inserted sheet of recording paper S' is indicated by a one-dot chain line in FIG. 1. This sheet of recording paper S' is also conveyed to the pressing portion of pinch roller 8 via sheet sensor 16 along paper pan 9.

A sheet of recording paper S is automatically fed by the rotation of sheet-feeding roller 18, while a sheet of recording paper S' manually fed by the operator is not fed by sheet-feeding roller 18. That is, in the present embodiment, whether a sheet is automatically fed or manually fed is determined based on the operation of sheet-feeding roller 18.

In the recording apparatus 1 shown in FIGS. 1 and 2, recording head 6 is separated from sheet sensor 16, and the apparatus is controlled so that recording is performed until the sheet of recording paper S is fed for a predetermined amount, for example, an amount from the first line to the tenth line corresponding to the central angle θ of sheet-feeding roller 2 after the trailing end of the sheet has passed through sheet sensor 16. Such a control is termed remaining-amount control processing.

That is, the remaining-amount control processing is performed for the range of the central angle θ. After the remaining-amount control processing has been terminated, the sheet of recording paper S is discharged. In an automatic sheet-feeding mode, the next sheet of recording paper S is fed (when next data to be recorded is present), and the recording operation is executed.

The central angle θ equals the angle between pinch roller 8 and sheet sensor 16. This is because the sheet is in pressure contact with sheet-feeding roller 2 between pinch roller 8 and recording head 6 and therefore the length of that distance is easily controlled, but the length between the trailing end of the sheet and pinch roller 8 after the trailing end of the sheet has passed through sheet sensor 16 is difficult to control.

In the present embodiment, in recording apparatus 1 in which the automatic sheet feeder is mounted and the remaining-amount control processing is performed, in the case of a sheet of recording paper S', which is not fed by the operation of sheet-feeding roller 18 but is manually fed, it is determined that the sheet is manually fed if sheet sensor 16 has confirmed the presence of the sheet of recording paper S' for at least a predetermined time period (a time period of about 1–3 seconds is suitable), and the sheet-feeding operation is automatically executed.

The determination if the sheet has been fed by sheet-feeding roller 18 may be performed, for example, by determining if a sheet-feeding signal for operating sheet-feeding roller 18 is output. That is, if a sheet-feeding signal is output, it is determined that the sheet has been automatically fed. If sheet sensor 16 has detected a sheet of recording paper S' in a state in which a sheet-feeding signal is not output, it is determined that the sheet is manually fed.

The predetermined time period (a time period of about 1–3 seconds is suitable) is a time period for providing a correct sheet-feeding operation so as to prevent the sheet of recording paper S' from being obliquely fed when the operator manually inserts the sheet.

The above-described operation is executed even in an error state other than a jam of the sheet of recording paper S (a restorable error, for example, an error in which no sheet of recording paper S is present and recording head 6 is removed).

The sheet-feeding operation when the sheet is manually fed is not necessarily the same as the sheet-feeding operation when the sheet is automatically fed.

When it is determined that the sheet has been manually fed, an off-line state is automatically provided, that is, the connection between the host computer and the recording apparatus is automatically released. Usually, in many apparatuses, the recording operation of the recording apparatus is also stopped in an off-line state. Hence, it is necessary to provide an off-line state after the recording operation for the first manually fed sheet of recording paper S' has been completed (completion including the remaining-amount control processing).

By thus providing an off-line state after it has been determined that the sheet has been manually fed, control by the host computer is not performed to prevent the subsequent automatic sheet-feeding operation, and manual insertion of the next sheet of recording paper S' is awaited. Hence, it is possible to manually insert sheets consecutively.

At that time, when the next sheet of recording paper S' has been manually inserted and an on-line state has again been provided by operating a key A, the sheet of recording paper S' is fed by an instruction from the host computer and recording is performed. After the recording operation of the sheet of recording paper S' has been completed, an off-line state is again provided. By repeating such an operation, sheets are manually fed consecutively.

When an off-line state has been provided, the host apparatus is notified of the fact via an interface with the host computer.

Figure 3:
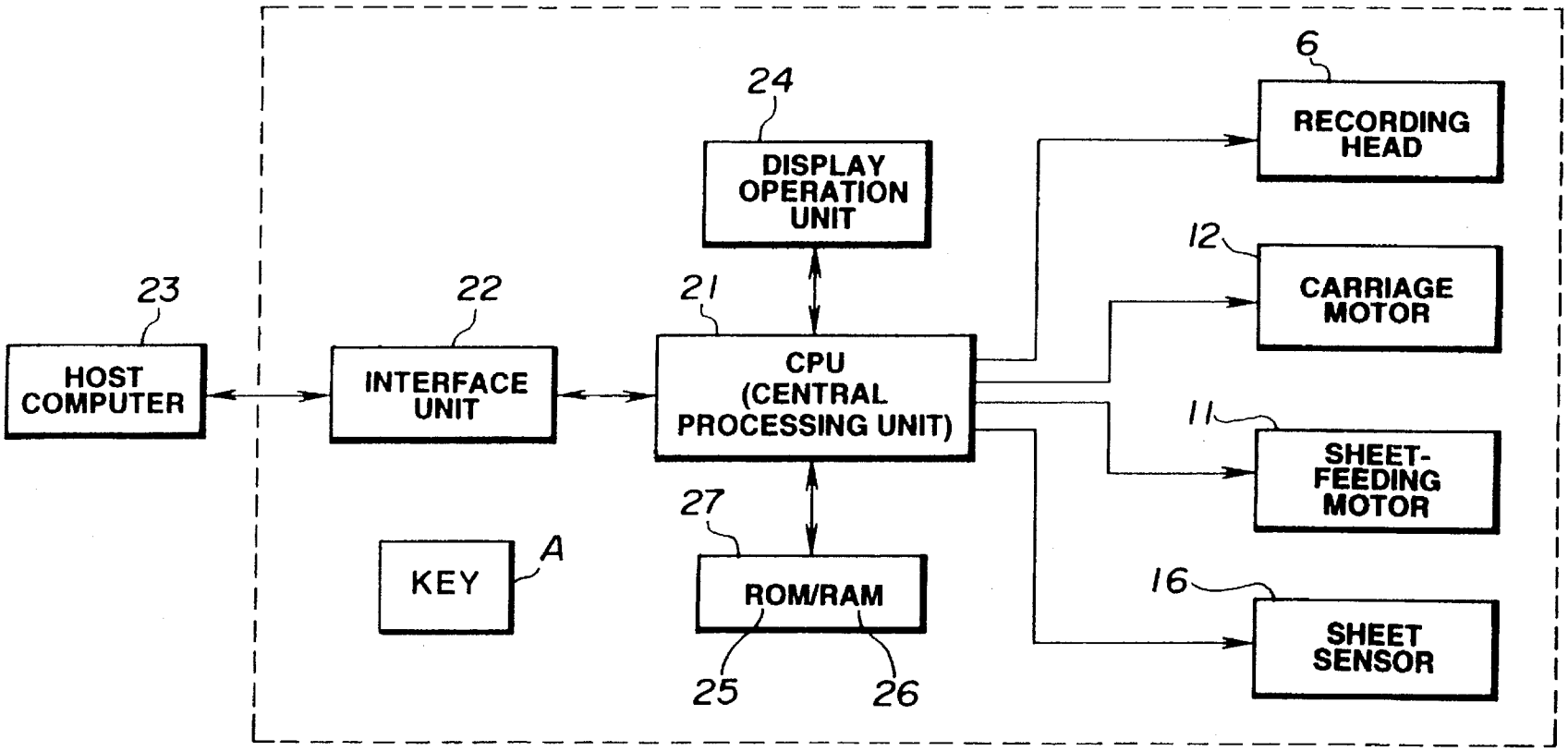
FIG. 3 is a block diagram of the control system of the recording apparatus shown in FIGS. 1 and 2.

FIG. 3 is a block diagram illustrating the control system of recording apparatus 1 shown in FIGS. 1 and 2.

In FIG. 3, CPU (central processing unit) 21 of recording apparatus 1 is connected to host computer 23, such as the main body of the computer, a word processor or the like, using various kinds of signal lines so that data can be transmitted and received.

Display operation unit 24, on which display lamps, key switches for various kinds of operations, and the like are disposed, and storage unit 27 including ROM (read-only memory) 25 and RAM (random access memory) 26 are connected to CPU 21.

Control programs, a CG (character generator) and the like are stored within ROM 25. A reception buffer for temporarily storing data transferred from host computer 23 is included in RAM 26.

CPU 21 controls recording head 6, carriage motor 12, sheet-feeding motor 11 and the like based on various kinds of input data and detection signals.

Figure 4:
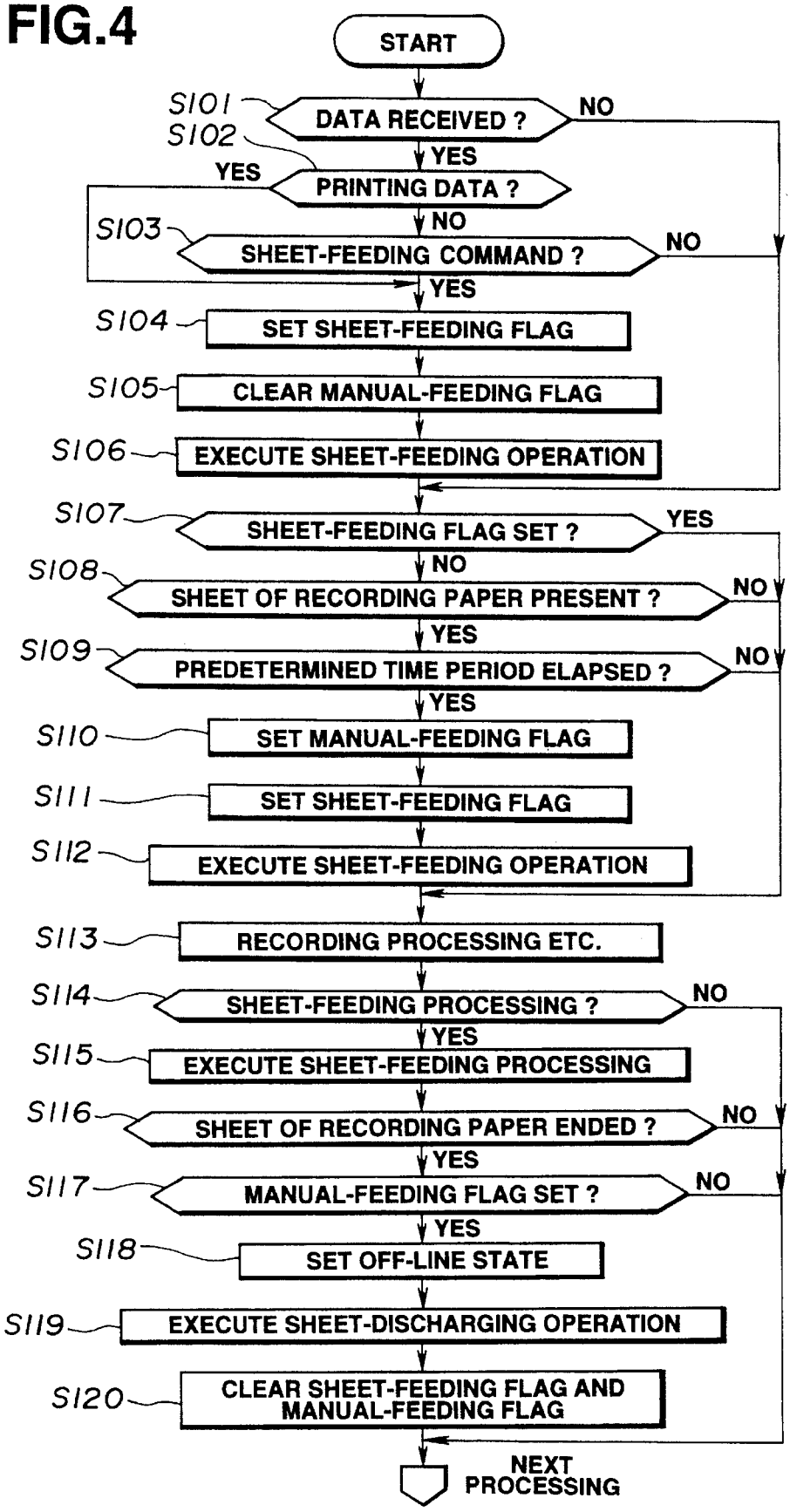
FIG. 4 is a flowchart of processing of switching between an automatic sheet-feeding operation and a manual sheet-feeding operation for the recording apparatus shown in FIGS. 1–3 according to a first embodiment of the present invention.

FIG. 4 is a flowchart illustrating processing of switching between an automatic sheet-feeding operation and a manual sheet-feeding operation in recording apparatus 1 having the configuration shown in FIGS. 1–3.

In FIG. 4, in step S101, determination if data has been received from host computer 23 is performed. If the result of the determination is negative, the process proceeds to step S107. If the result of the determination is affirmative, the process proceeds to step S102, in which the received data is read, and determination whether the data comprises recording data (character data or image data) or a control command for recording apparatus 1 is performed. If the data comprises recording data, the process proceeds to step S104.

If the data comprises a control command, the process proceeds to step S103, in which determination if the control command is a sheet-feeding command for recording apparatus 1 is performed. If the result of the determination is affirmative, the recording position must be changed, and the sheet of recording paper S must be fed. If the control command is a command other than a sheet-feeding command (for example, a command to change the recording mode), the process proceeds to step S107.

In step S104, a sheet-feeding flag indicating execution of a sheet-feeding operation is set before executing the sheet-feeding operation. This sheet-feeding flag is cleared when the operation of feeding the sheet of recording paper S has been completed including the remaining-amount control processing.

In step S105, a flag indicating a manual sheet-feeding operation is cleared because an automatic sheet-feeding operation is executed. In some cases, the sheet-feeding operation is changed in response to this flag. Such processing is executed in interrupt processing (not shown).

In step S106, the sheet-feeding operation is executed. Actually, only a starting operation for sheet feeding is performed in this step. The processing of actually driving the motor is executed by interrupt processing (not shown) or the like. A flag for detailed control, for example, a control to check if the sheet-feeding operation has been completed, is not illustrated.

In step S107, the setting of the sheet-feeding flag, indicating whether the sheet-feeding operation is being executed or has been completed, is checked. If the sheet-feeding flag is set, the step proceeds to step S113 without executing the subsequent processing of checking the sheet-feeding operation, and a recoding operation or the like (not necessarily a recoding operation, and processing of changing the recording mode is also included) is executed. On the other hand, if the sheet-feeding flag has been cleared as a result of the check in step S107, the process proceeds to step S108 in order to execute determination for the manual sheet-feeding operation.

In step S108, the presence of the sheet of recording paper S is detected by the sheet sensor 16 shown in FIG. 1. If the result of the detection is negative, the process proceeds to step S113, in which processing, such as a recording operation and the like, is executed. If the result of the detection is affirmative, a timer (not shown) is set. This timer is configured so as to perform counting in a state in which sheet sensor 16 detects the presence of the sheet of recording paper S.

In step S109, it is determined if the value of the timer has reached a predetermined value. If the result of the determination is negative, the process proceeds to step S113, in which processing, such as a recording operation and the like, is executed.

After a predetermined time period has elapsed, the process proceeds to step S110, in which a manual sheet-feeding operation is executed.

In step S110, a manual-feeding flag indicating a state of manual sheet feeding is set (because the sheet-feeding operation must be changed in response to this flag).

In step S111, the sheet-feeding flag is set as in the above-described step S104.

In step S112, the sheet-feeding operation is executed. As in the above-described step S106, only a starting operation for sheet feeding is performed, and the actual operation is executed by interrupt processing (not shown) or the like.

In step S113, processing, such as recording processing, a change of the recording mode, and the like, is executed.

In step S114, it is determined if the sheet of recording paper S subjected to recording in step S113 is to be conveyed. If the result of the determination is affirmative, the process proceeds to step S115. If the result of the determination is negative, the next processing, such as key check and the like, is executed.

In step S115, a sheet-feeding operation is executed in accordance with the amount of sheet feeding which is currently set. The actual sheet-feeding operation is executed by interrupt processing. In this step, a starting operation for sheet feeding is performed to change the current position. If the current position exceeds the set page length, it is determined that the sheet of recording paper S has ended.

In step S116, it is determined if the current sheet of recording paper S has ended. If the result of the determination is negative, the next processing, such as key check and the like, is executed. Since only a starting operation for sheet feeding is performed in the above-described step S115, the determination if the sheet of recording paper S has actually ended is performed by interrupt processing (not shown). If the result of the determination in step S116 is affirmative, the process proceeds to step S117, in which the presence of the manual-feeding flag set in step S105 or step S111 is checked. If the result of the check is negative, the next processing, such as key check and the like, is executed. If the result of the check in step S117 is affirmative, the process proceeds to step S118, in which off-line processing is executed. The off-line processing provides a state in which communication with the host computer is temporarily interrupted.

In step S119, a starting operation for processing of discharging the sheet of recording paper S which has ended is performed. The actual processing of driving the motor is executed by interrupt processing (not shown).

In steps S120 and S121, since the processing of discharging the sheet of recording paper S has been executed, the sheet-feeding flag and the manual-feeding flag are cleared, and the process proceeds to the next processing, such as key check and the like. Thereafter, the next sheet of recording paper S is manually inserted. If the state is changed from the off-line state to an on-line state by operating a key (not shown), the sheet is fed and recording processing is performed.

In the on-line state, the transmission/reception of data with the host computer can be performed, and an automatic sheet-feeding operation can be executed.

In the above-described first embodiment, the recording apparatus is configured such that in the case of a manually fed sheet of recording paper S' which is not fed by the operation of sheet-feeding roller 18, if it is determined by the detection of sheet sensor 16 that the sheet of recording paper S' is present for a predetermined time period (a time period of about 1–3 seconds is suitable), a manual sheet-feeding operation is automatically executed. When the manual sheet-feeding operation has been completed, off-line processing is executed. Thus, the manual sheet-feeding operation can be performed consecutively after automatically switching to the manual sheet-feeding operation.

Next, a second embodiment of the present invention will be described.

Figure 5:
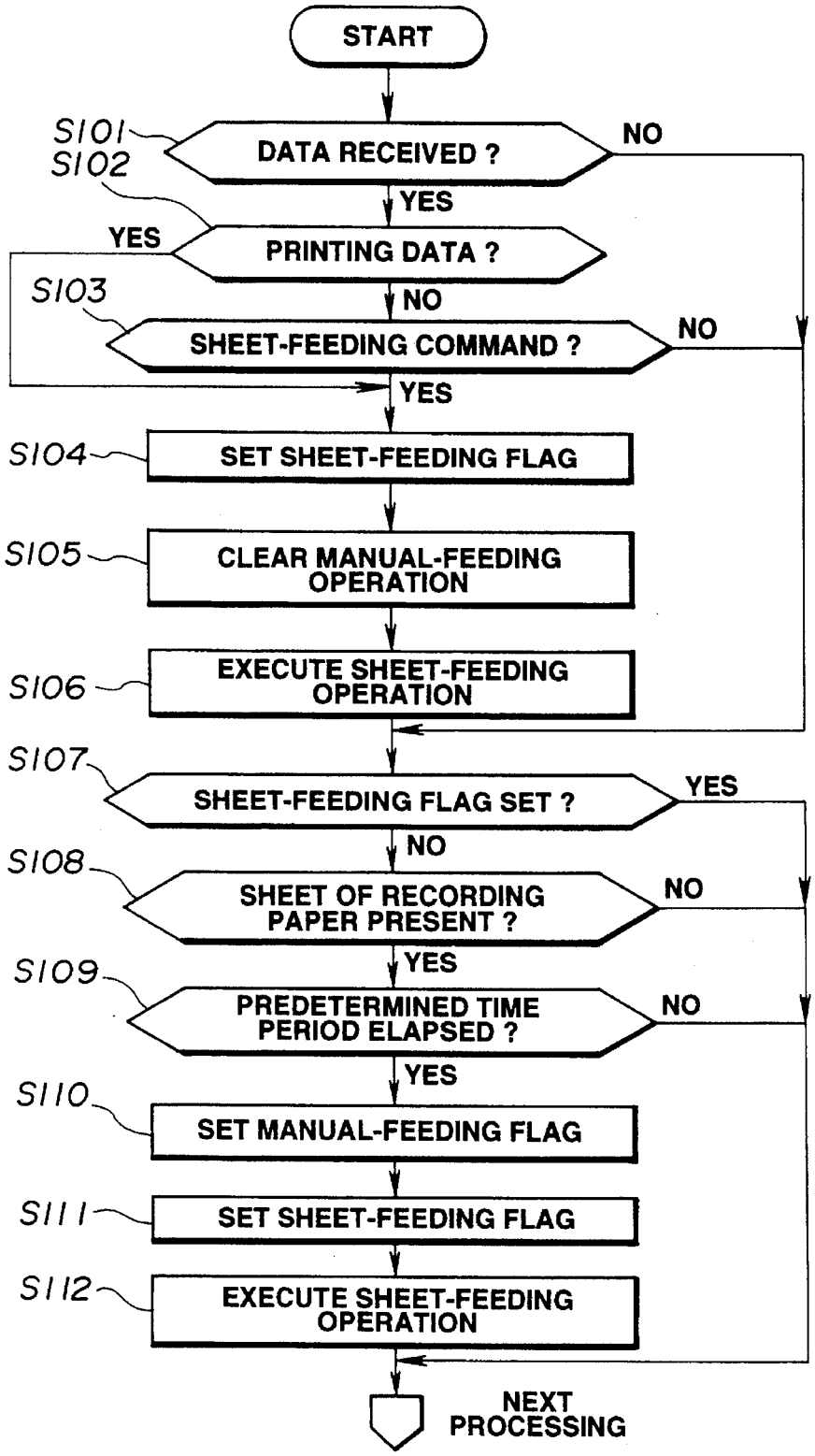
FIG. 5 is a flowchart of processing of switching between an automatic sheet-feeding operation and a manual sheet-feeding operation for the recording apparatus shown in FIGS. 1–3 according to a second embodiment of the present invention.
Figure 6:
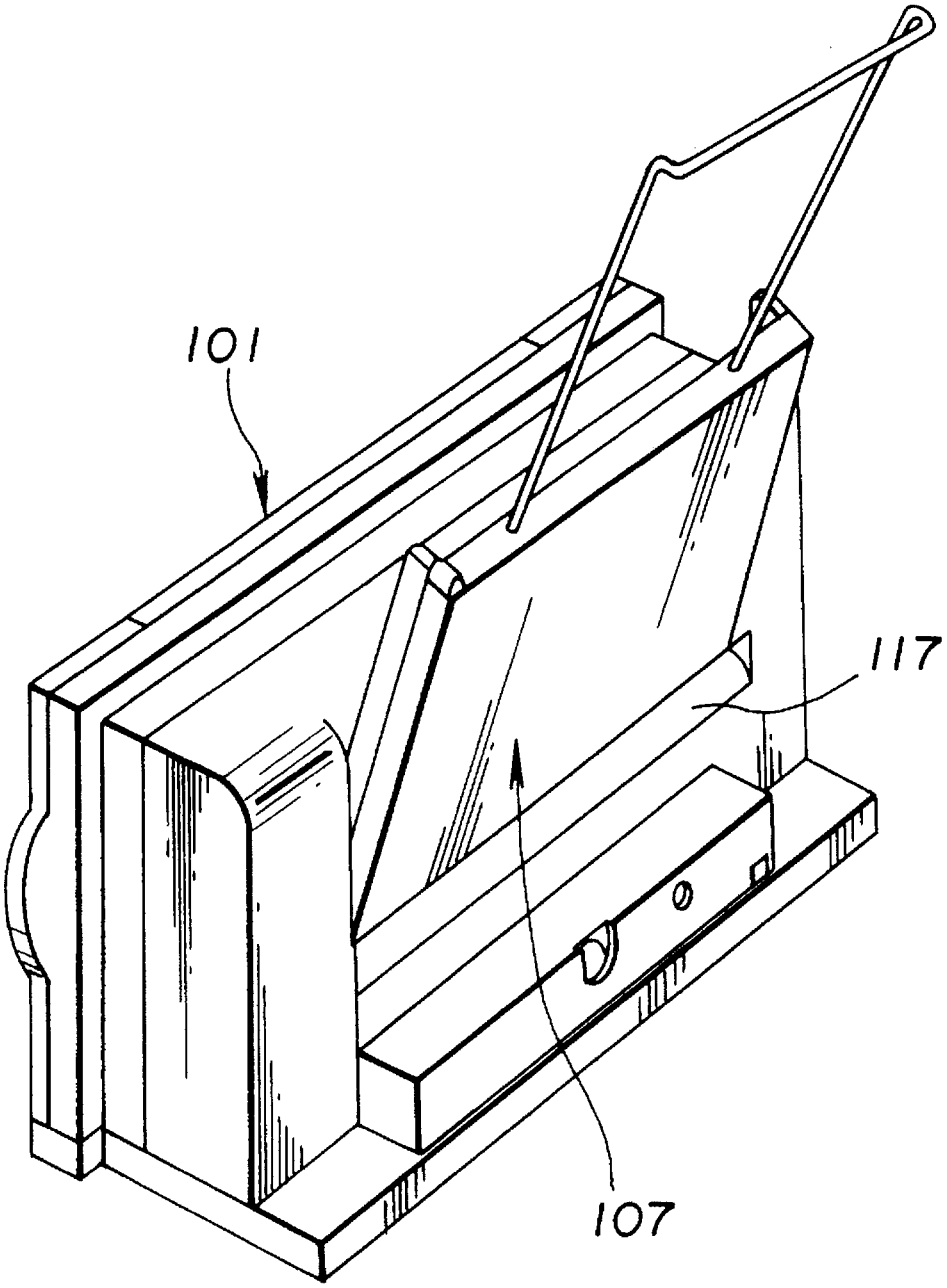
FIG. 6 is a perspective view of a conventional recording apparatus.

In a recording apparatus of the second embodiment, a manual sheet-feeding operation can be performed irrespective of an on-line state or an off-line state. FIG. 5 is a flowchart illustrating the operation of switching between automatic sheet feeding and manual sheet feeding in recording apparatus 1 of the second embodiment.

In FIG. 5, in step S101, determination if data has been received from host computer 23 shown in FIG. 3 is executed. If the result of the determination is negative, the process proceeds to step S107. If the result of the determination is affirmative, the process proceeds to step S102, in which the received data is read, and determination whether the data comprises recording data (character data or image data) or a control command for recording apparatus 1 is performed. If the data comprises recording data, the process proceeds to step S104.

If the data comprises a control command, the process proceeds to step S103, in which determination if the control command is a sheet-feeding command for recording apparatus 1 is performed. If the result of the determination is affirmative, the recording position must be changed, and the sheet of recording paper S must be fed. If the control command is a command other than a sheet-feeding command (for example, a command to change the recording mode), the process proceeds to step S107.

In step S104, a sheet-feeding flag indicating execution of a sheet-feeding operation is set before executing the sheet-feeding operation. This sheet-feeding flag is cleared when the operation of feeding the sheet of recording paper S has been completed including the remaining-amount control processing.

In step S105, a flag indicating a manual sheet-feeding operation is cleared because an automatic sheet-feeding operation is executed. In some cases, the sheet-feeding operation is changed in response to this flag. Such processing is executed in interrupt processing (not shown).

In step S106, the sheet-feeding operation is executed. Actually, only a starting operation for sheet feeding is performed in this step. The processing of actually driving the motor is executed by interrupt processing (not shown) or the like. A flag for detailed control, for example, a control to check if the sheet-feeding operation has been completed, is not illustrated.

In step S107, the setting of the sheet-feeding flag, indicating whether the sheet-feeding operation is being executed or has been completed, is checked. If the sheet-feeding flag is set, the step proceeds to the next processing without executing the subsequent processing of checking the sheet-feeding operation, and a recording operation or the like (not necessarily a recording operation, and processing of changing the recording mode is also included) is executed. On the other hand, if the sheet-feeding flag has been cleared as a result of the check in step S107, the process proceeds to step S108 in order to execute determination for the manual sheet-feeding operation.

In step S108, the presence of the sheet of recording paper S is detected by the sheet sensor 16 shown in FIG. 1. If the result of the detection is negative, the process proceeds to the next processing. If the result of the detection is affirmative, a timer (not shown) is set. This timer is configured so as to perform counting in a state in which sheet sensor 16 detects the presence of the sheet of recording paper S.

In step S109, it is determined if the value of the timer has reached a predetermined value. If the result of the determination is negative, the process proceeds to the next processing.

After a predetermined time period has elapsed, the process proceeds to step S110, in which a manual sheet-feeding operation is executed.

In step S110, a manual-feeding flag indicating a state of manual sheet feeding is set (because the sheet-feeding operation must be changed in response to this flag).

In step S111, the sheet-feeding flag is set as in the above-described step S104.

In step S112, the sheet-feeding operation is executed. As in the above-described step S106, only a starting operation for sheet feeding is performed, and the actual operation is executed by interrupt processing (not shown) or the like.

In the above-described second embodiment, the apparatus is configured such that irrespective of whether in an on-line state or in an off-line state, when a sheet of recording paper S', which is not fed by the operation of sheet-feeding roller 18, has been manually fed, if it is determined by the detection of sheet sensor 16 that the sheet of recording paper S' is present for at least a predetermined time period (a time period of about 1–3 seconds is suitable), a manual sheet-feeding operation is automatically executed. Thus, it is possible to securely and automatically shift to the manual sheet-feeding operation. The manual sheet-feeding operation is executed even in a case other than a jam, for example, in an error state in which recording head 6 is removed from the apparatus.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus whose recording operation is controlled by being connected to a host computer, said apparatus comprising:

sheet supporting means for supporting a plurality of sheets;

feeding means for feeding a sheet supported by said sheet supporting means;

a manual insertion port for manually inserting a sheet into said apparatus;

conveying means for conveying the sheet fed from said sheet supporting means or the sheet inserted from said manual insertion port;

recording means for performing a recording operation on the sheet fed by said conveying means;

sheet detection means for detecting the sheet inserted from said manual insertion port; and control means for controlling so as to execute a recording operation in a manual mode based on the detection of the manually inserted sheet by said sheet detection means, and for temporarily providing an offline state with respect to the host computer after the recording operation of the manually inserted sheet has been completed.

2. A recording apparatus according to claim 1, wherein said sheet detection means comprises a detection sensor for detecting the sheet conveyed by said conveying means, and wherein when said detection sensor has detected a sheet when said feeding means does not operate, said sheet detection means determines that the detected sheet is a manually inserted sheet.

3. A recording apparatus according to claim 2, wherein when the state of detecting the sheet by said detection sensor continues for a predetermined time period, said sheet detection means determines that the detected sheet is a manually inserted sheet.

4. A recording apparatus according to claim 1, further comprising input means for changing a state of the apparatus from an off-line state to an on-line state.

5. A recording apparatus according to claim 1, wherein said sheet detection means detects a trailing end of the sheet conveyed by said conveying means after being fed by said feeding means or after being inserted from said manual insertion port, and wherein said control means causes said recording means to continue the recording operation for a predetermined amount based on the detection.

6. A recording apparatus according to claim 5, wherein said recording means continues the recording operation in accordance with a distance between said sheet detection means and a conveying member, provided at a side downstream from said sheet detection means, for conveying the sheet while grasping it.

7. A recording apparatus whose recording operation is controlled by being connected to a host computer, said apparatus comprising:

sheet supporting means for supporting a plurality of sheets;

feeding means for feeding a sheet supported by said sheet supporting means;

a manual insertion port for manually inserting a sheet into said apparatus;

conveying means for conveying the sheet fed from said sheet supporting means or the sheet inserted from said manual insertion port;

recording means for performing a recording operation on the sheet fed by said conveying means;

detection means for detecting the sheet inserted from said manual insertion port; and control means for controlling so as to execute a manual sheet-feeding operation irrespective of an on-line state or an off-line state with respect to the host computer when said detection means has detected the manually inserted sheet for a predetermined period of time.

8. A recording apparatus according to claim 7, wherein said detection means comprises a detection sensor for detecting the sheet conveyed by said conveying means, and wherein when said detection sensor has detected a sheet when said feeding means does not operate, said detection means determines that the detected sheet is a manually inserted sheet.

9. A recording apparatus according to claim 7, wherein said control means causes the apparatus to execute the manual sheet-feeding operation even in an error other than a jam.

10. A recording apparatus according to claim 7, further comprising input means for changing a state of the apparatus from an off-line state to an on-line state.

11. A recording apparatus whose recording operation is controlled by being connected to a host computer, said apparatus comprising:

sheet supporting means for supporting a plurality of sheets;

feeding means for feeding a sheet supported by said sheet supporting means;

a manual insertion port for manually inserting a sheet into said apparatus;

conveying means for conveying the sheet fed from said sheet supporting means or the sheet inserted from said manual insertion port;

recording means for performing a recording operation on the sheet fed by said conveying means;

detection means for detecting the sheet fed from said sheet supporting means and the sheet inserted from said manual insertion port; and control means for discriminating whether the sheet detected by said detection means is a sheet fed from said feeding means or a sheet inserted from said manual insertion port, and for controlling so as to execute a recording operation in a manual mode or in an automatic mode in accordance with the discrimination.

12. A recording apparatus according to claim 11, wherein said control means discriminates that the sheet detected by said detection means is the sheet fed from said manual insertion port when said detection means has detected a manually inserted sheet for a predetermined period of time, and said control means controls so as to execute the recording operation in the manual mode.

* * * * *

UNITED STATES PATENT AND TRADEMARK OFFICE

CERTIFICATE OF CORRECTION

PATENT NO. : 5,557,369

DATED : September 17, 1996

INVENTOR(S) : Shiga et al.

It is certified that error appears in the above-indentified patent and that said Letters Patent is hereby corrected as shown below:

COLUMN 2:

Line 11, "fop" should read --for--.

COLUMN 6:

Line 58, "recoding" should read --recording--.
Line 59, "recoding" should read --recording--.

Signed and Sealed this

Eighteenth Day of March, 1997

Bruce Lehman

*Attest:*

BRUCE LEHMAN

*Attesting Officer*

*Commissioner of Patents and Trademarks*